US006036242A

United States Patent [19]

Lin

[11] Patent Number: 6,036,242

[45] Date of Patent: Mar. 14, 2000

[54] PORTABLE ANTI-THEFT DOOR LOCK

[76] Inventor: Wu Chin Lin, P.O. Box 82-144, Taipei, Taiwan

[21] Appl. No.: 08/998,975

[22] Filed: Dec. 29, 1997

[51] Int. Cl.[7] ..... E05C 19/18

[52] U.S. Cl. ..... 292/292; 292/288

[58] Field of Search ..... 292/292, 288, 292/289, 290, 295, 296, 297, 298, 258, DIG. 60; 70/14

[56] References Cited

U.S. PATENT DOCUMENTS

| | | | |
|---|---|---|---|
| 1,299,808 | 4/1919 | Stroke | 292/297 |
| 1,671,454 | 5/1928 | Stoutenburgh | 292/292 |
| 3,161,428 | 12/1964 | Zook | 292/292 |
| 4,285,535 | 8/1981 | Leary | 292/258 |
| 4,878,701 | 11/1989 | Rondel et al. | 292/292 |
| 5,664,814 | 9/1997 | Lin | 292/290 |

*Primary Examiner*—Rodney M. Lindsey
*Attorney, Agent, or Firm*—A & J

[57] ABSTRACT

A portable anti-theft door lock includes a lock body, a positioning bar, and an alarm device. The lock body is comprised of upper and lower casings having end threaded portions. Urging nuts are fitted over the end threaded portions, one being adjustable, the other being provided with an elastomeric element. One of the end threaded portions accommodates an alarm device provided with a switch having a trigger shaft. A press rod is also disposed inside the threaded portions with its press portion projecting from a side hole. An end of the press rod engages a recess of a slide block. The slide block is provided with a projection as well. The projection engages a fastening hole of the positioning bar having a circular end. The positioning bar passes through a central open slot of the lock body.

1 Claim, 4 Drawing Sheets

PORTABLE ANTI-THEFT DOOR LOCK

BACKGROUND OF THE INVENTION

1. Field of the Invention

The present invention relates generally to an anti-theft door lock, and more particularly to a portable anti-theft door lock.

2. Description of the Prior Art

A conventional anti-theft door lock comprises a core which includes a connecting seat and at least branch connecting seat extending from one side of the connecting seat; a lock hook element having a front end one side of which is provided with a retaining portion, and a rear end provided with a connecting element for locking with the connecting seat; and an urging rod having a connecting portion connectable with the branch connecting seat for urging against the door and door frame. There are, however, various drawbacks with this structure:

1. In use, the lock hook element and the urging rod must be turned at the core to adjust their distance with the door and door frame, which is very inconvenient to operate.
2. The strength of such conventional anti-theft door locks is poor and may easily be damaged when thieves try to break in through the door.

SUMMARY OF THE INVENTION

The present invention relates generally to an anti-theft door lock, and more particularly to a portable anti-theft door lock.

A primary object of the present invention is to provide a portable anti-theft door lock which is easy to operate and quick to install.

Another object of the present invention is to provide a portable anti-theft door lock having an alarm device.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
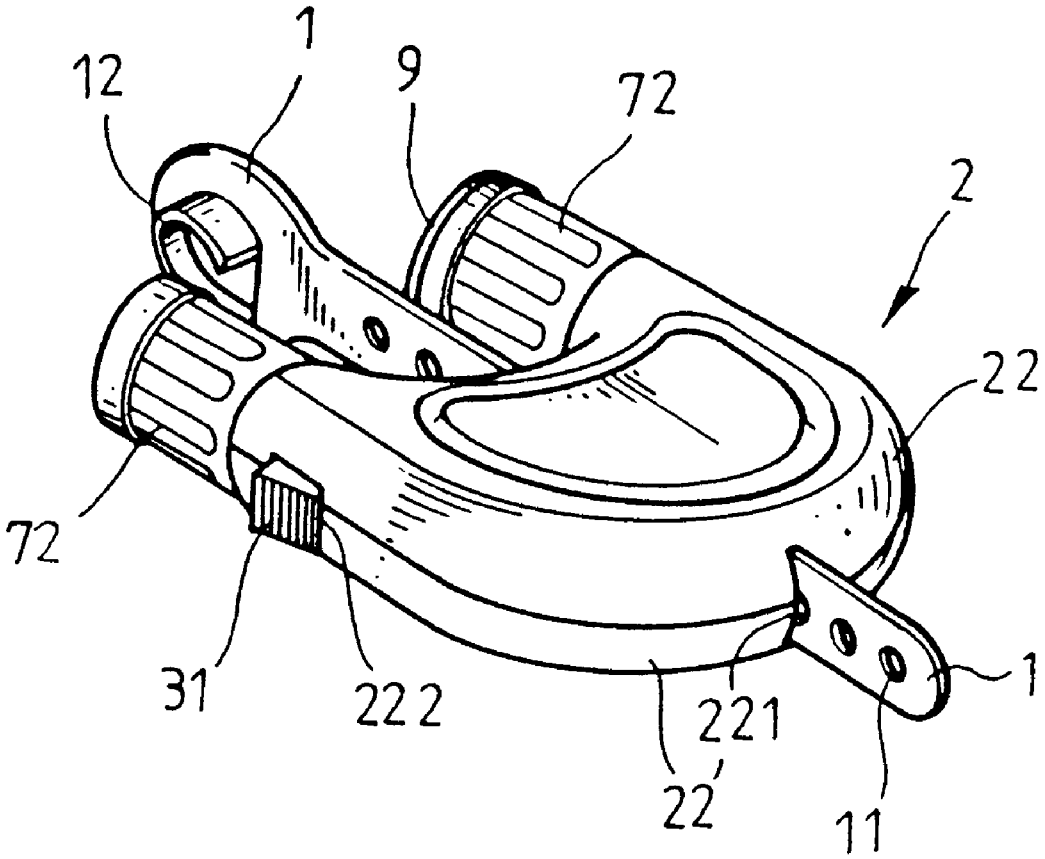
FIG. 1 is a perspective assembled view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
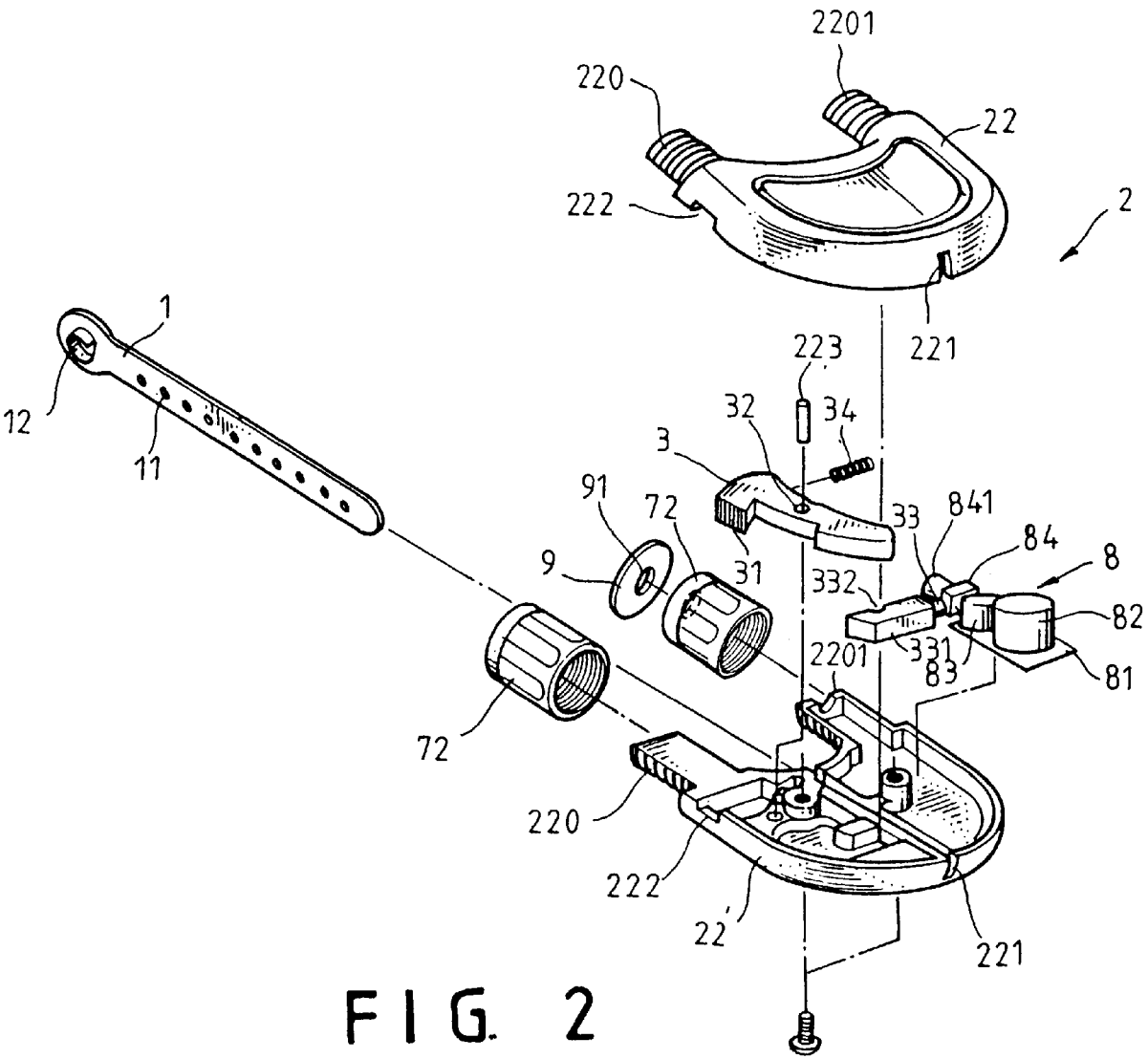
FIG. 2 is a perspective exploded view of the present invention.
Figure 3:
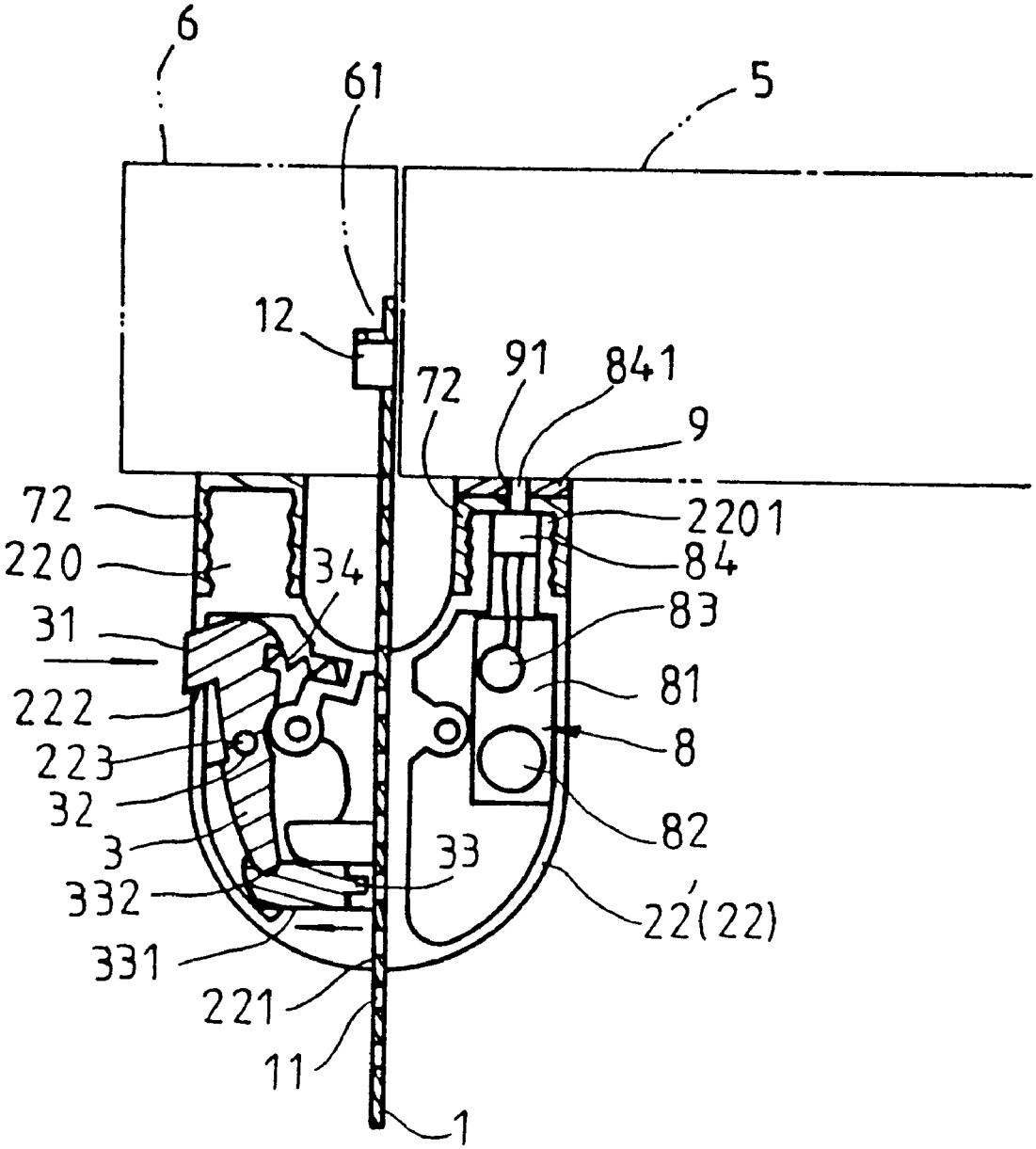
FIG. 3 is a sectional view of the present invention in an unlocking state.
Figure 4:
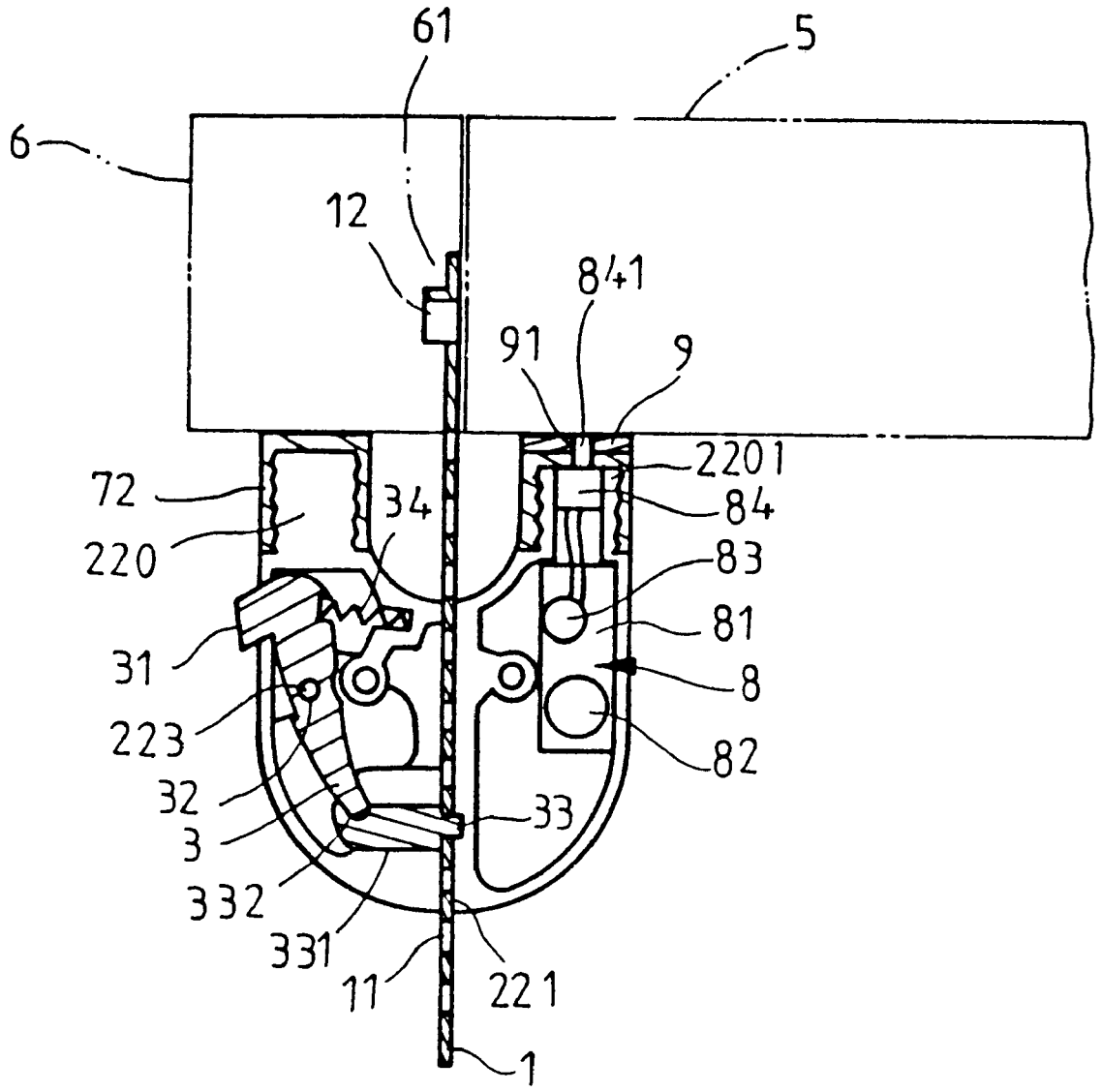
FIG. 4 is a sectional view of the present invention in a locked state.

With reference to FIGS. 1 and 2, the present invention comprises a a positioning bar 1, a lock body 2, and an alarm device 8. The lock body 2 includes an upper casing 22 and a lower casing 22', respectively having a solid threaded portion 220 of a semi-circular cross-section and a hollow threaded portion 2201 of a shorter length at their rear ends. The upper and lower casings are coupled using screws such that the solid threaded portions form solid cylindrical portions and the hollow threaded portions form cylindrical portions with an internal hollow. Urging nuts 72 are screwably fitted onto the threaded portions 220 and 2201, adapted to urge against a door 5 or a door frame 6 (as shown in FIGS. 3 and 4). The urging nut 72 on the shorter threaded portion 2201 is provided with an elastomeric element 9 having a central through hole 91 at its end. A switch 84 having a trigger shaft 841 at its end is disposed inside the lock body 2, and the trigger shaft 841 extends through the central through hole 91 of the elastomeric element 9 to contact with the door 5. A press rod 3 is disposed inside the threaded portion 2201. The press rod 3 is provided with a press portion 31 at one side which is exposed on a side hole 222 formed when the upper and lower casings are coupled. The user may press the press portion 2201 through the side hole 222. The center of the press rod 3 is a shaft hole 32. A shaft 223 is inserted into the shaft hole 32 to serve as a pivot to allow deflection. A spring 34 is biased against the press rod 3 for resetting purposes. In order to allow it to couple with the positioning bar 1 provided in a central slot 221 of the upper and lower casings, a slide block 331 capable of horizontal displacement is provided at its end. The front end of the slide block 331 is provided with a projection 33 for engaging fastening holes 11 of the positioning bar 1 with a circular projecting block 12. The lower end is provided with a recess 332 for receiving the press rod 3. By means of the action of the press rod 3, the positioning bar 1 can be caused to horizontally displace.

With reference to FIG. 3, in use, the positioning bar 1 with the projecting block 12 is inserted into a lock hole 61 of the door frame 6 and the press portion 31 is pressed through the side hole 222 of the lock body 2. At this point, the slide block 331 is pulled outwardly at an angle, that is, the press rod 3 uses the shaft 223 in the central shaft hole 32 to rotate, bringing the slide block 331 to move therewith, thus causing the slide block 331 of the projection to move away from an open slot 221 at the center of the upper and lower casings. Then the positioning bar 1 will pass through its center. When unlocking, the spring 34 at the inner side of the press rod 3 will be compressed. Referring now to FIG. 4, when the press portion 31 is released, the press rod 3 will reset, and the projection 33 with the slide block 331 will enter the fastening hole 11 of the positioning bar 1, so that the urging nuts 72 of the lock body 2 can be easily adjusted to abut evenly and tightly with the surface of the door frame 6 and the door 5. When someone tries to break in through the door 5, the trigger shaft 841 of the alarm device 8 will firstly sound and, due to the lock body and the positioning bar 1, the door 5 will remain close. To unlock, just press the press portion 31 so that the lock body 2 can be and the positioning bar can be removed. Operation is very easy and convenient.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A portable anti-theft door lock, comprising:

a positioning bar having a circular end portion provided with fastening holes, and a projecting block insertable into a lock hole of a door frame; and a lock body including upper and lower casings each having end threaded portions of a semi-circular cross-section, one being longer and solid, the other being shorter and hollow, said end threaded portions of said upper and lower casings forming cylindrical threaded portions when being coupled, said lock body further having urging nuts fitted over said cylindrical threaded portions adapted to urge against the door frame or a door, the urging portion on the shorter and hollow one of said cylindrical portions further having an elastomeric element having a central through hole at its end, said lock body further including an alarm device disposed therein, said alarm device having an end provided with a switch with a trigger shaft, a battery and a buzzer being disposed on a circuit board thereof to generate sound, a press rod being further disposed in said threaded portions, said press rod having a press portion projecting from a side hole of said lock body and being centrally provided with a shaft hole for insertion of a shaft therethrough, a spring being disposed between an inner side and a central open slot of said lock body, a slide block having a projection at its end and a recess at a lower portion being insertably disposed at an upper end, said projection passing through one of said fastening holes of said positioning bar fitted in the central open slot of said lock body for positioning purposes.

* * * * *